US005898408A

United States Patent [19]

Du

[11] Patent Number: 5,898,408

[45] Date of Patent: Apr. 27, 1999

[54] WINDOW MOUNTED MOBILE ANTENNA SYSTEM USING ANNULAR RING APERTURE COUPLING

[75] Inventor: Xin Du, Bartlett, Ill.

[73] Assignee: Larsen Electronics, Inc., Vancouver, Wash.

[21] Appl. No.: 08/740,204

[22] Filed: Oct. 24, 1996

Related U.S. Application Data

[XX .

[60] Provisional application No. 60/008,071, Oct. 25, 1995.

[51] Int. Cl.[6] ..... H01Q 1/32

[52] U.S. Cl. ..... 343/715; 343/713; 343/769

[58] Field of Search ..... 343/711, 712, 343/713, 715, 767, 769; H01Q 1/32

[56] References Cited

U.S. PATENT DOCUMENTS

| | | | |
|---|---|---|---|
| Re. 33,743 | 11/1991 | Blaese | 343/715 |
| 2,026,652 | 1/1936 | Ponte . | |
| 2,206,820 | 7/1940 | Mydlil . | |

(List continued on next page.)

FOREIGN PATENT DOCUMENTS

| | | |
|---|---|---|
| 458 592 A2 | 11/1991 | European Pat. Off. . |
| 1203227 | 8/1958 | France . |
| 1227757 | 6/1959 | France . |
| 3537107 | 10/1985 | Germany . |
| 1-36128 | 2/1989 | Japan . |
| 1-77230 | 3/1989 | Japan . |
| 6303016 | 10/1994 | Japan . |

OTHER PUBLICATIONS

Gianola, et al., "General Computation of Co–Polar and Cross–Polar Components of Arbitrary Aperture Coupled Multilayer Microstrip Antennas," *Antennas and Propagation* Apr. 4–7, 1995, Conference Publication No. 407, pp. 29–33, © IEEE.

Kamiya, et al., "Design for Dual–Frequency Microstrip Antenna Using Annular Slot Aperture Coupling," 91/CH3036–1/0000–1118, pp. 1118–1121, © IEEE 1991. (No Month Being Provided).

Ikrath, et al., "Slot–Coupled Vehicles (Trucks, Tanks, and Jeeps) Performing as VHF Antennas," Communications/Automatic Data Processing Laboratory, U.S. Army Electronics Command, Fort Monmouth, NJ, AP–S Session 12, 0940, pp. 387–390. (No Date Being Provided).

Pozar, "Improved Coupling for Aperture Coupled Microstrip Antennas," *Elec. Lett.* 27, pp. 1129–1131 (Jun. 1991).

Saed, "Slot–Coupled Circular Microstrip Antenna Having a Symmetric Radiation Pattern," Department of Electrical Engineer, State University of New York, 0–7803–1246–5 1993, pp. 1204–1206, © IEEE (May 1993).

Takeuchi, et al., "Characteristics of a Slot–Couped Microstrip Antenna Using High–Permittivity Feed Substrate," *Electronics and Communications in Japan, Part 1*, 78:3, pp. 85–94 (1995). (No Month Being Provided).

Fink, Electronics Engineers' Handbook, McGraw–Hill Book Company, 1st Ed., 1975, pp. 3–3. (No Month Being Provided).

(List continued on next page.)

*Primary Examiner*—Don Wong
*Assistant Examiner*—Tho Phan
*Attorney, Agent, or Firm*—Klarquist Sparkman Campbell Leigh & Whinston, LLP

[57] ABSTRACT

A low cost window-mounted antenna system for mobile communication systems operating at frequencies in and above the 1.5 GHz band includes an annular ring aperture coupler fabricated on printed circuit boards on each side of the window, with a microstrip line etched on each of the printed circuit boards. A collinear array-type whip antenna with a ½-wavelength lower section is used with the coupler. A coplanar waveguide trace is printed on the outside coupling unit to form an impedance matching network for the active element. The RF signal is thus electro-magnetically coupled through the window.

34 Claims, 4 Drawing Sheets

U.S. PATENT DOCUMENTS

| | | | |
|---|---|---|---|
| 2,559,613 | 7/1951 | Halstead . | |
| 2,829,367 | 4/1958 | Rychlik . | |
| 3,364,487 | 1/1968 | Maheux . | |
| 3,657,652 | 4/1972 | Smith . | |
| 4,001,834 | 1/1977 | Smith . | |
| 4,028,704 | 6/1977 | Blass . | |
| 4,089,817 | 5/1978 | Kirkendall | 343/713 |
| 4,238,799 | 12/1980 | Parfitt | 343/715 |
| 4,621,243 | 11/1986 | Harada . | |
| 4,658,259 | 4/1987 | Blaese . | |
| 4,692,770 | 9/1987 | Kadokura . | |
| 4,764,773 | 8/1988 | Larsen et al. | 343/713 |
| 4,779,098 | 10/1988 | Blaese . | |
| 4,785,305 | 11/1988 | Shyu | 343/713 |
| 4,794,319 | 12/1988 | Shimazaki . | |
| 4,804,969 | 2/1989 | Blaese . | |
| 4,825,217 | 4/1989 | Choi . | |
| 4,839,660 | 6/1989 | Hadzoglou | 343/715 |
| 4,850,035 | 7/1989 | Schiller . | |
| 4,857,939 | 8/1989 | Shimazaki | 343/715 |
| 4,862,183 | 8/1989 | Blaese . | |
| 4,931,806 | 6/1990 | Wunderlich | 343/715 |
| 4,939,484 | 7/1990 | Harada | 333/24 R |
| 4,992,800 | 2/1991 | Parfitt | 343/713 |
| 5,017,934 | 5/1991 | Blaese . | |
| 5,023,622 | 6/1991 | Blaese . | |
| 5,059,971 | 10/1991 | Blaese . | |
| 5,105,201 | 4/1992 | Nakase et al. | 343/715 |
| 5,451,966 | 9/1995 | Du et al. | 343/715 |
| 5,471,222 | 11/1995 | Du | 343/713 |
| 5,557,290 | 9/1996 | Watanabe | 343/715 |

OTHER PUBLICATIONS

Johnson, Transmission Lines and Networks, McGraw–Hill Book Company, 1950, p. 239 (No Month Being Provided).

Ora Electronics brochure, "Static Noise and Cross Talk When Using Your Portable Cellular Telephone Inside a Car?" 1990, 2 Pages. (No Month Being Provided).

Ora Electronics, "Passive Repeater for Portable Cellular Telephones," May 1990, 5 page publication.

dbMobile Brochure,"Active Link Repeater Installation Manual," Apr. 1994, 14 pages.

$$\theta = \frac{\omega W}{P}$$

$$\frac{Pd}{Pt} = \frac{\theta t}{\theta d}$$

$$\text{Transmission loss} = 10\log\left(1 + \frac{Pd}{Pt}\right)$$

WINDOW MOUNTED MOBILE ANTENNA SYSTEM USING ANNULAR RING APERTURE COUPLING

RELATED APPLICATION DATA

This application is a continuation of copending provisional application Ser. No. 60/008,071 filed Oct. 25, 1995, the disclosure of which is incorporated by reference.

TECHNICAL FIELD

The present invention relates to a communication antenna system fed through a dielectric wall, and more particularly relates to through-glass coupling systems for antennas used at frequencies above 1.5 GHz (e.g. PCN, PCS, and ISM services).

BACKGROUND AND SUMMARY OF THE INVENTION

Window mounted antennas have gained more and more popularity in mobile radio links, especially in cellular telephone communications because of their obvious advantages to the consumer. These advantages include the ease of installation and the fact that it is not necessary to drill a hole in the vehicle. Many efforts in designing effective window mounted antenna systems have been disclosed in the patent literature. The majority of these are capacitively coupled systems. With the introduction of PCNIPCS (Personal Communication Network/Personal Communication Services), capacitive coupling becomes troublesome due to the doubling of the frequency and bandwidth requirements.

U.S. Pat. No. 4,089,817 to Kirkendall illustrates one capacitively coupled antenna system for use with half wavelength antennas. U.S. Pat. No. 4,839,660 to Hadzoglou discloses another capacitive coupling system—this one for use with a bottom radiation element of between ¼-wavelength and ½-wavelength. (Hadzoglou's bottom radiation element cannot be a full dipole because of the high transition impedance sensitivity at a ½-wavelength.) U.S. Pat. Nos. 4,992,800 to Parfitt, 4,857,939 to Shimazaki, and 4,785,305 to Shyu, follow similar principles, all involving LC matching networks and capacitive coupling through the vehicle glass.

Capacitive coupling systems (e.g conducting patches mounted on opposing sides of window/windshield glass to form a capacitor coupling RF energy therethrough) suffer from a number of disadvantages, summarized below:

1) To present a substantially capacitive reactance, the coupling patches cannot be large in comparison with the operating wavelength. High impedance coupling (several hundred ohms) results, leading to losses through the leakage of electrical field at high frequencies.
2) In the higher UHF bands, such as the 1.5–2.4 GHz frequencies used for PCN/PCS/ISM services, even a "small" coupling patch does not behave as a lumped capacitor element. Considering the thickness of vehicle glass and stray capacitance, the coupling circuit can bypass the signal and make it more difficult to match the high impedance of the antenna to a 50 ohm system.
3) The high impedance coupling afforded by capacitive coupling creates a moisture sensitive structure. U.S. Pat. No. 4,764,773 to Larsen describes a better coupling structure to improve performance in the presence of moisture, but it is still subject to patch size limitations.

In addition to problems with capacitive coupling systems, the conventional collinear array antenna presents problems of its own. For example, such antennas do not have uniform current distributions; the lower section of the whip exhibits the strongest radiation. In most vehicle mounting situations, the lower section of the whip is blocked by the roof of the vehicle, causing severe pattern distortion and deep nulls. This situation becomes worse in the 1.7–2.4 GHz PCS/PCN/ISM bands simply because the length of the radiator is less than half that at the 800 MHz cellular band due to the more than doubling of the frequency. To reduce this problem, elevated feed systems are sometimes employed. But antennas with elevated feeds are not easily matched for broadband operation (e.g. up to 11% for DCS-1800). Moreover, such elevated feed systems often present a low impedance (e.g. 50 ohms) at the through-glass coupling point, limiting the through-glass coupling techniques that can be used. If traditional capacitive coupling is employed, a matching network must, somewhere, be employed to transform impedances. Such matching networks tend to have prohibitive losses at the high UHF frequencies of the PCN/PCS/ISM services (typically 4–6 dB).

U.S. Pat. No. Reissue 33,743 to Blaese describes a different capacitively coupling system for coupling a coaxial cable through the glass. But at the PCN/PCS/ISM frequencies, the quarter-wave antenna employed by Blaese would be only 1.7 inches long—completely below the roof line of a vehicle, causing severe pattern distortion and deep nulls. U.S. Pat. No. 4,939,484 to Harada discloses a coupler comprising helix cavities for through-glass coupling. While suitable for use in the 800 MHz cellular band, this arrangement has a number of drawbacks when scaled to the 1.8 GHz PCS band. For example, the coupling aperture becomes undesirably small. Moreover, the helix Q is relatively small due to the size of the helix. Still further, the coupling coefficient is too small to provide adequate coupling over the wide (11%) PCS band. Manufacturing and tuning are complicated by the high frequency and the coupler's complex 3D structure.

Most of the above-discussed drawbacks are present with other through-glass couplers described in the prior art (notwithstanding the prior art's laudatory assertions of their general applicability at frequencies above the 800 MHz cellular band).

Accordingly, there is a need for an improved method of through-glass (or through other dielectric) coupling for use at gigahertz frequencies.

One attempt to meet this need is disclosed in my U.S. Pat. No. 5,471,222. The disclosed system employs microwave cavities containing high Q ceramic resonators, with RF signals fed through the glass by a pair of $TE_{01\delta}$ mode dielectric resonators.

The disclosed approach is highly efficient, with an insertion loss of 0.5dB (through 5 mm automobile glass at 1.8 GHz) attainable with careful tuning. However, this design is expensive to manufacture and is sensitive to detuning in the field.

Another attempt to meet this need is disclosed in my U.S. Pat. No. 5,451,966. In that system, a rectangular slot coupling scheme replaces the expensive ceramic couplers of my '222 patent. (The concept of slot coupling on a microstrip antenna (MSA) is understood to have originated with Pozar. See, e.g., his publication "Improved Coupling for Aperture Coupled Microstrip Antennas," Elec. Lett., Vol. 27, pp. 1129–1131, June, 1991.) Slot coupling is used to overcome the narrow band nature of MSA. A "doggie bone" type of slot, suggested by Pozar, significantly increases the magnetic polarisability on the slot, allowing a short slot to provide the necessary coupling while at the same time keeping the backward emissions low. Pozar and other researchers' work has generally been limited to numerical solutions of slot-fed microstrip antennas and multilayer arrays on a ground plane. But the bandwidth advantages of this type of MSA can be used to enhance the concept of the planar slot-cavity coupler. Furthermore, recent progress in low cost, high performance microwave printed circuit board material has brought about the opportunity to make this type of antenna system affordable for commercial applications. Based on this MSA process, a "doggie bone" type slot coupled antenna system was developed with the coupling element etched on low loss Teflon™ PCB and it has proven to be quite successful in the field.

Unexpectedly, I have discovered that a simpler and less costly coupling technique is capable of achieving the same superior performance of the previous arrangement, while at the same time providing various advantages over the rectangular slot approach.

One issue in the existing slot-coupled approach is cascade coupling, which can be diagrammed as:

cable→microstrip→slot→glass→ slot→microstrip→i.m.n.→antenna

Another issue is the so-called "MSA effect." The E field excited by a rectangular slot is always distributed perpendicularly to the slot, making the opposite coupler an antenna patch. The inner and outer PCB, however, must be limited in size to satisfy the resonant frequency. This introduces a substantial loss inherent in all slot-fed variations of the MSA.

Moreover, radiation always occurs at the edges of the resonant direction of the patch (i.e. perpendicular to the slot) by means of an equivalent magnetic current represented as $M=E\times\hat{n}$. The presence of a larger ground plane supports the tangential portion of the E field. When a rectangular slot is used as a glass coupler, the edge E field still exists, leading to a radiation loss. In the previous art, the lengths of the two ground planes on the PC board are selected and aligned in the resonant direction to form a glass mount antenna. The MSA effect is obviously observed.

Finally, to achieve a high coupling coefficient, long slot lengths arguably should be used. But this presents the problem of increasing backwards radiation.

In accordance with the preferred embodiment of the present invention, through-glass coupling is achieved with an annular ring type aperture coupling arrangement. One advantage of this approach over rectangular slot coupling is that it raises the coupling coefficient, which is important for coupling through a relatively thick dielectric wall. Another advantage is that the radial distribution of the E field from an annular ring aperture tends to increase the aperture coupling and reduce edge coupling.

The annular ring aperture coupler of the present invention also aids the issue of backwards radiation from the slot itself. FIG. 2 presents an estimated radiation resistance of an annular ring slot according to the preferred embodiment. For a rectangular slot, as mentioned by Pozar and other researchers, the backwards radiation of a slot-fed MSA can effectively be cut by shortening the slot length and end-loading the slot to retain a sufficient coupling coefficient. This technique can also be applied to glass couplers; An annular ring is the complementary element of a small loop antenna and, like the loop antenna, presents a low radiation efficiency, but this effect is here turned to advantage by reducing backwards radiation. A larger E field aperture can be achieved, with less MSA effect. An impedance matching network is avoided by connecting the CPW line directly to the center resonant element instead of using a transition coupling scheme, as described in the prior art. With this improvement, the i.m.n. stays in the same layer as the resonant element, facilitating fabrication (e.g. a single layer PCB or simple stamped metal parts).

By the foregoing arrangement, the loss mechanisms of the prior art are largely eliminated, leaving just the dielectric loss of the vehicle glass. Results like that of the ceramic coupler arrangement are thus achieved, without its cost, manufacturing, and detuning drawbacks.

One object of the preferred embodiment is thus the provision of a cost effective glass mount antenna system operating at frequencies higher than the existing cellular band.

Another object is the provision of a through-glass coupler that is simpler than the prior art, facilitating mass production and lowering manufacturing costs.

Another object is the provision of a through-glass coupler operating at relatively low impedance while enabling a high feeding point and providing broadband operation.

Another object is the provision of a through-glass coupler that minimizes loss factors present in the prior art.

Another object is the provision of a through-glass coupler that reduces backward radiation while maintaining a high coupling coefficient.

Another object is the provision of a through-glass coupler that reduces edge-coupling effects of the prior art.

The foregoing and other objects, features and advantages of the present invention will be more readily apparent from the following detailed description, which proceeds with reference to the accompanying drawings.

DESCRIPTION OF THE PREFERRED EMBODIMENT

Figure 1:
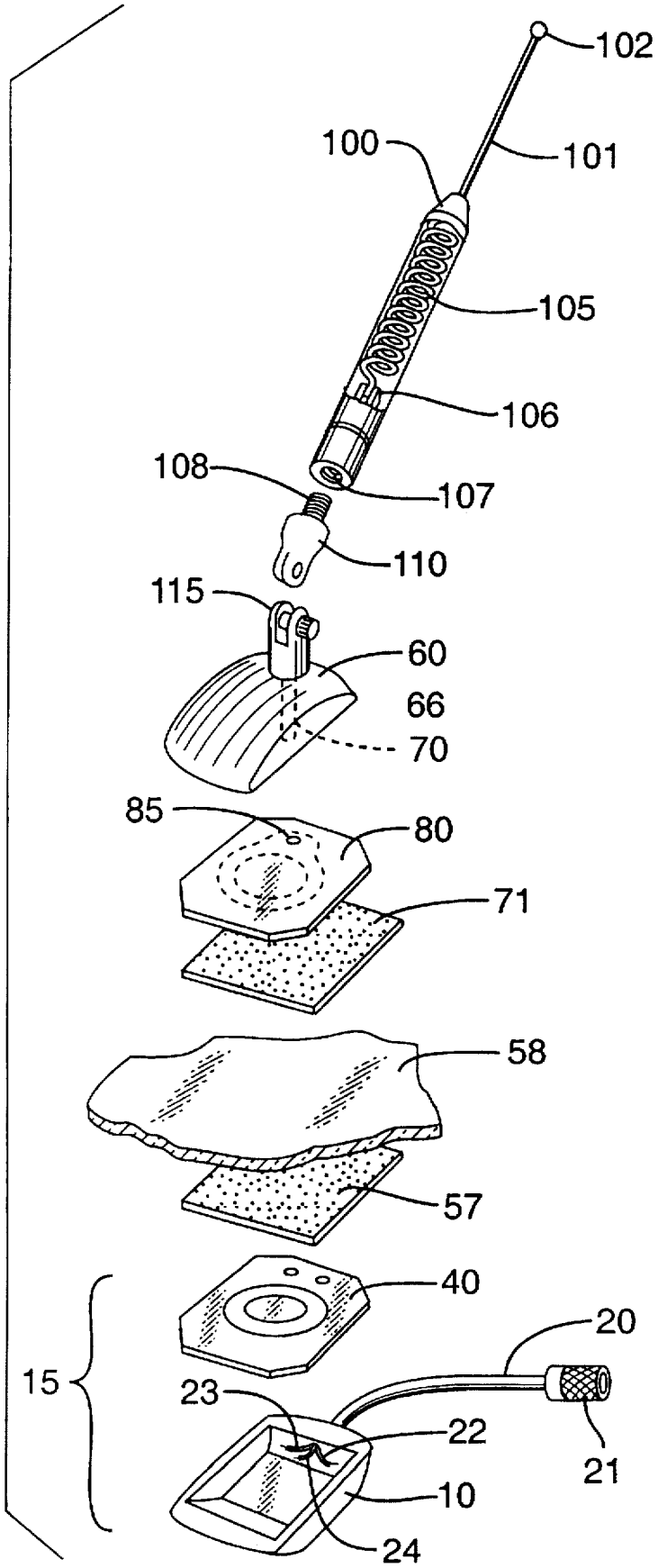
FIG. 1 is an exploded view of an antenna system employing annular ring aperture coupling according to one embodiment of the present invention.
Figure 2:
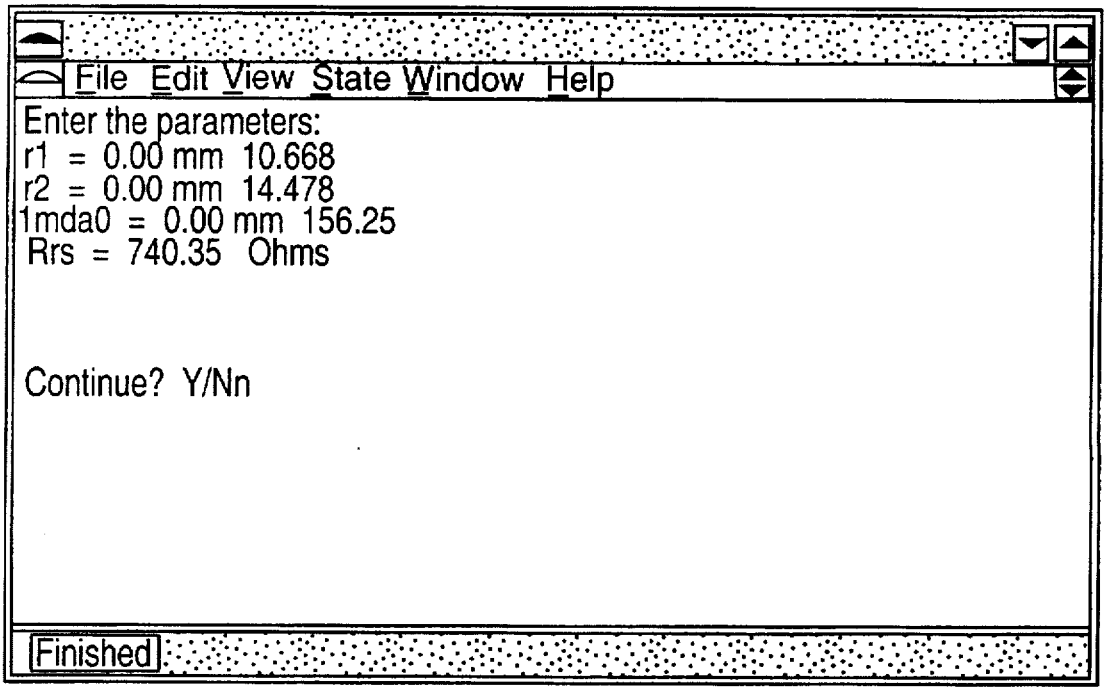
FIG. 2 shows an estimated radiation resistance of the annular ring slot employed in FIG. 1.

FIG. 1 shows an exploded view of an antenna system 12 employing an annular ring aperture coupling arrangement according to one embodiment of the present invention. Antenna system 12 includes an antenna assembly 100, an outside assembly 66, an inside assembly 15, and a feed cable assembly 20.

The antenna assembly 100 comprises a collinear array with an upper ½- to ⅝-wavelength radiator 101, and a ½-wavelength lower radiator 106. The two radiators are separated by an air-wound phasing coil 105. This array is desirably encapsulated with a low loss plastic material through a molding process. At the bottom of this molded plastic is formed a threaded coupler 107, which screws onto a corresponding threaded post 108, allowing the antenna (whip) to be removed from the antenna assembly, e.g. at a car wash. Post 108 is formed on a conductive swivel member 110, which engages with a corresponding conductive swivel part 115 to set the angle of the antenna (using set screw 120). A ball 102 is positioned on the end of the upper element to improve bandwidth and enhance physical safety.

Normally, a ½-wavelength radiator has a sharp resonant impedance characteristic, significantly limiting its bandwidth A ⅝-wavelength radiator is better, but some energy is consumed at the out-of-phase section near the feeding point, and the radiation resistance is too low when the feeding point is "bulky." A ½-wavelength lower section has many advantages over its ¼- or ⅜-wavelength counterpart as described in Parfitt's early patents. First, the dependency on the ground plane is significantly reduced. For the same reason, feed line emissions are cut since less current flows on the outside conductor of the feed cable. Also, emissions to the passenger compartment are much less, compared to that from a ¼- or ⅜-wavelength lower sections, since relatively little current is present at the bottom of the antenna (it is relatively "cold"). Another important feature is that a ½-wavelength lower section effectively raises the feed point above the roof line of the vehicle, creating a more uniform radiation pattern.

In Parfitt's early patents, there is a high impedance formed at the feed point, making the antenna moisture sensitive and reducing its bandwidth. Further, it may be noticed that a ⅜-wavelength lower section is used in Parfitt's recent work (U.S. Pat. No. 4,992,800) to improve performance. It has been found that a ½-wavelength section with a small length/diameter ratio, or a "bulky"feeding point, can be easily matched. The outside diameter of the lower radiating element is selected to satisfy the bandwidth as well as to preserve cosmetic appearance and enhance rigidity. A metal rod and a "bulky" swivel assembly smooth the impedance significantly. Therefore, a broadband ½-or ⅝- over ½-wavelength collinear array can be realized. For best results, an approximately ½-wavelength lower section is utilized in the preferred embodiment to minimize the sensitivity.

The illustrated outside assembly 66 includes a housing 60, a printed circuit board 80, and double-sided adhesive tape 71 for mounting the PC board/housing to a window 58.

Housing 60 includes the swivel part 115 insert-mounted therein (thereby providing good rigidity and moisture isolation). Housing 60 can be made of a thermal plastic such as LEXAN™ (a GE material) for rigidity and UV stability. PC board 80 (discussed below) is bonded or thermo-pressed into the plastic housing 60, and is covered by the adhesive tape 71. The tape 71 is commercially available from 3M; a thickness of 0.045 is used in the illustrated embodiment. Holes 86 in circuit board 80 are furnished for mounting and reducing dielectric loss.

The inside assembly 15 includes a housing 10, a second printed circuit board 40, and double-sided adhesive tape 57 for mounting the PC board/housing to the window 58.

Housing 10 is made of thermal plastic such as ABS. Again, the PC board 40 is bonded or thermo-pressed onto the plastic housing 10 (through holes 43, 44 and 45) and is covered by the adhesive pad 57.

Cable assembly 20 can employ any type of popular low loss coaxial cable. One end of cable 20 is terminated at the inside coupling housing 10. More particularly, a center conductor 24 of the cable is soldered to a microstrip line member 47 on the PCB 40. The coaxial cable braid, which is split in two bundles, illustrated as 22 and 23, are soldered to ground 46 (FIG. 3B) on the PC board member 40.

In the illustrated system, the remote end of the coaxial cable 20 is connected to an RF connector 21 for connection to a radio transceiver.

Figure 3A:
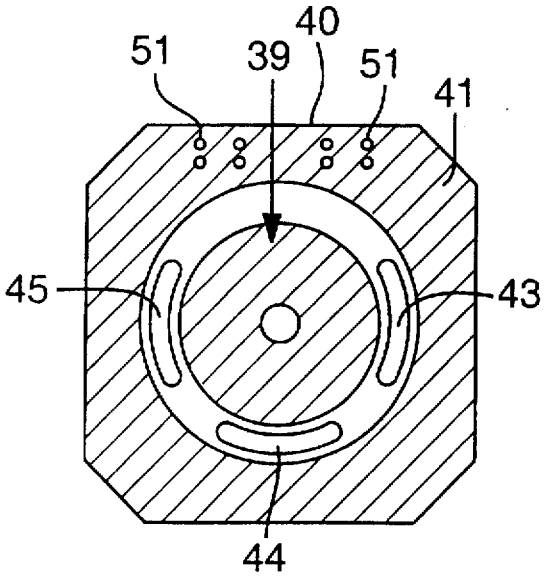
FIGS. 3A and 3B illustrate a first portion of the through-glass coupler employed in FIG. 1.
Figure 3B:
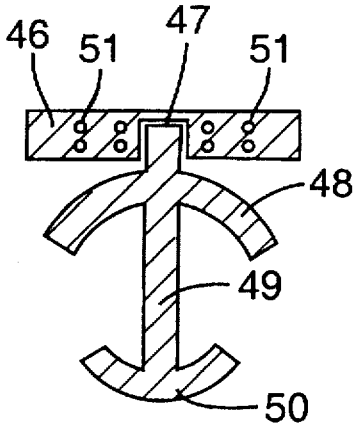

FIGS. 3A and 3B illustrate the inside coupling member 40. As indicated, shield (braid) members 22, 23 of the feed cable 20 are soldered to ground 46 on PC board 40. Ground 46 is connected by plated vias 51 to a ground plane 41 on the opposite side of the board (FIG. 3A). This construction facilitates assembly and soldering in a production line. Trace members 47, 48, 49 and 50 (FIG. 3B) are microstrip lines, forming an "Anchor" type impedance matching network and a transition coupling between element 39 on the glass side of board 40, and the feed line 20.

Figure 4:
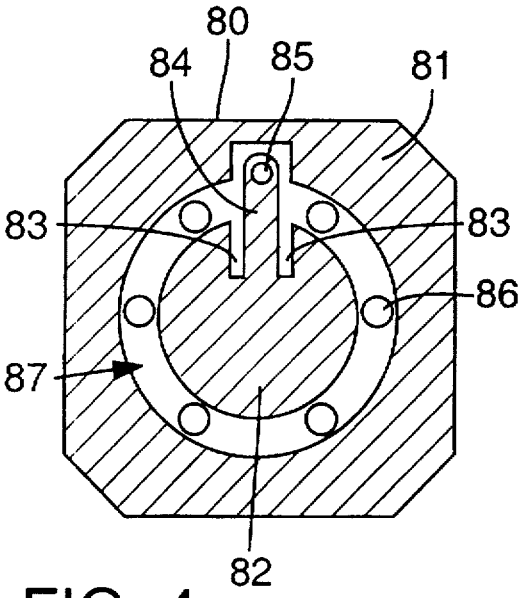
FIG. 4 illustrates a second portion of the through-glass coupler employed in FIG. 1.

Outside the glass, facing the FIG. 3A circuit board, is the surface of PC board 80 shown in FIG. 4. This surface includes an annular slot 87 defined between copper-clad regions 81 and 82. Along with a microstrip feeding line 84, a planar cavity is constructed. The slot 87 is designed to have a width to length ratio of about 0.1 to satisfy the requirement of at least 11% bandwidth. The inside feeding microstrip line 84, which is typically 50 ohms, is extended across the slot 87 by 5–7 mm in the preferred embodiment to obtain proper impedance matching.

Trace 84 serves as a high impedance CPW section which impedance matches to the antenna element 100. More particularly, one end of trace 84 is connected (by soldering at point 85) directly to an antenna base member 70, and the other end is attached to the annular ring (patch) member 82. Notches 83 adjacent trace 84 serve to tune the electrical length of the CPW line 84. By this arrangement, single layer layout is used to simplify the structure. It will be recognized that the illustrated conductive surfaces cooperate to form an annular ring slot resonant circuit.

Figure 5:
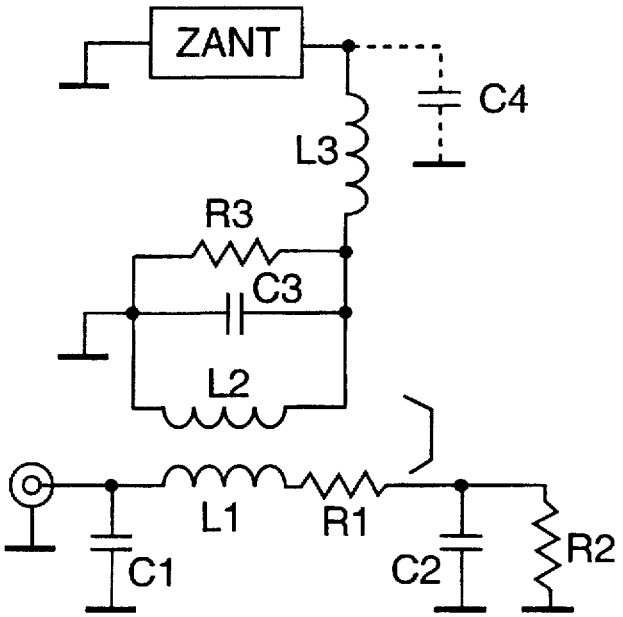
FIG. 5 shows an equivalent circuit of the antenna system of FIG. 1.

FIG. 5 shows an equivalent circuit. Since the aperture structure is a quasi-open resonant system, it is necessary to use low loss material to reduce the excessive loss incurred by the feeding line and impedance matching circuit.

Several transition coupling techniques between the annular aperture and the cable feeding system were investigated and compared for system optimization. One prior art method, disclosed in Bahl et al, *Microstrip Antennas* (1980), places a microstrip line across the annular ring slot and extends to a certain length. Unfortunately the resulting frequency response is quite sharp and the coupling coefficient is not sufficient for a dielectric comprising 4–6 mm of glass with the associated pair of adhesive tapes. The illustrated tuning circuit thus was developed and it was found that this "Anchor" arrangement of microstrip line provides a sufficient coupling coefficient while at the same time providing the bandwidth required by PCN/PCS. (The basic idea is to expand the bandwidth by a double tuned resonant circuit; keep a maximum E field intensity at the annular ring portion; and distribute it evenly.)

It was found that the illustrated embodiment is not as sensitive to the size and shape of the printed circuit board structures as the prior art. This implies a reduction of edge coupling found in prior art, rectangular slot approaches. Still, certain restrictions apply. The length of the PC boards is chosen to be slightly bigger than a free space ¼-wavelength but less than a waveguide ½-wavelength, in order to avoid resonance at the operating frequency when the adhesive-glass-adhesive dielectric wall are taken into account.

The lengths of the inside and outside annular ring slots are selected to avoid resonance in the desired operational band. The annular rings provide sufficient aperture, by themselves, for coupling; no loading is required. The "Anchor" coupling transformer assures that maximum current occurs at the annular aperture-resonant slots at the individual operating frequency. When two of the aperture resonant system are placed face-to-face together, the strongest coupling occurs, since the magnetic polarisability is concentrated on the slot aperture. The presence of the glass wall and the adjacent resonant circuit changes the resonant frequency of the entire system and pulls the resonant frequency back to the desired operating frequency even when they are non-resonant circuits at the operating frequency individually.

Figure 6:
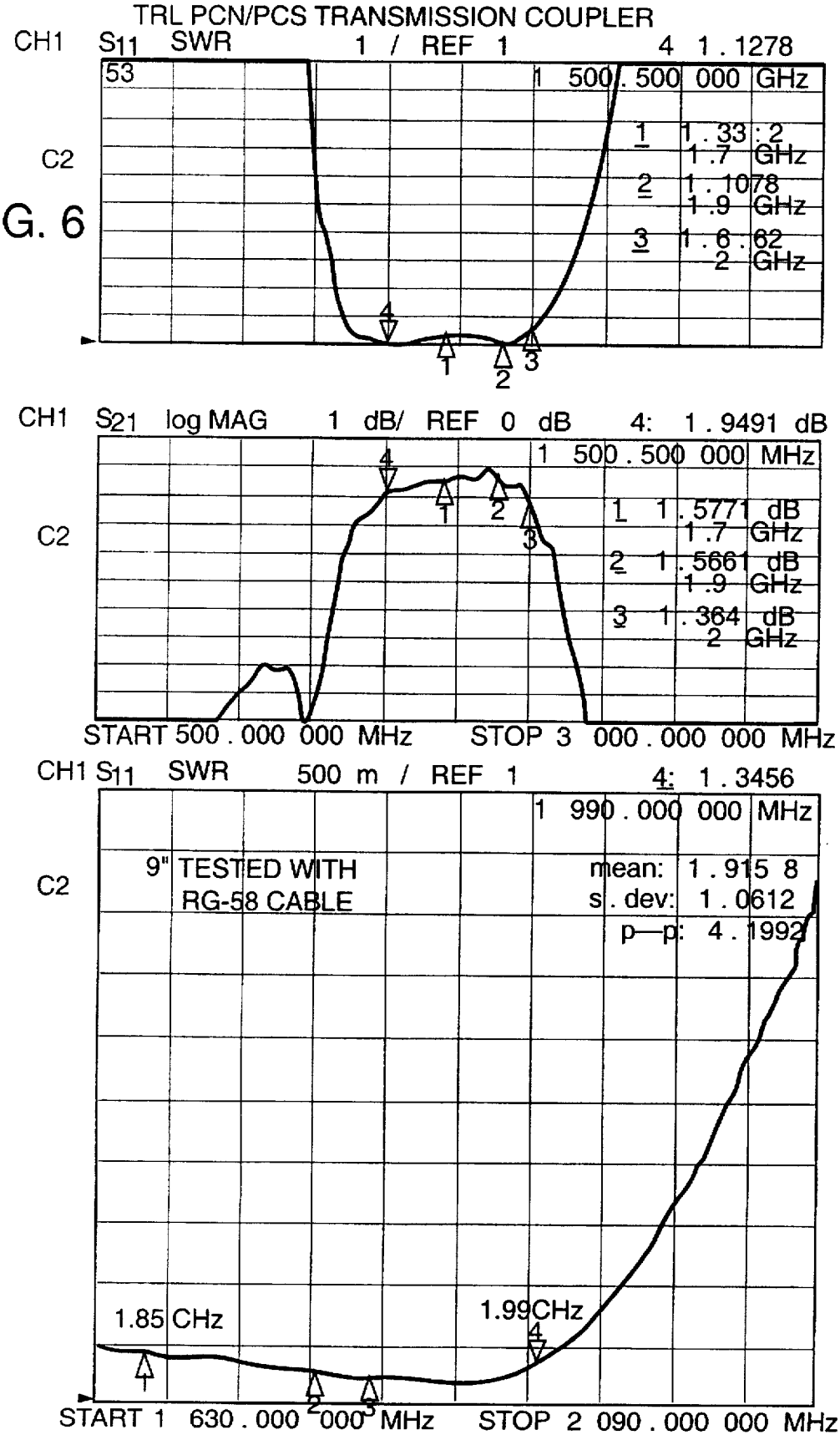
FIG. 6 is a graph showing typical insertion loss of the FIG. 1 coupler, and the resultant VSWR characteristics.

The upper half of FIG. 6 shows the transmission loss of a pair of prototype couplers measured with 50 Ohm test cable used with two 1 mm adhesive tapes on each side of a piece of automobile glass having a thickness of about 4 mm. It is noticed that no spurious responses are found at adjacent communication bands. A bandpass characteristic is thus achieved with this simple arrangement. Cable loss is calibrated out for accuracy. It is clear that a low impedance coupling is achieved. The lower chart is the typical VSWR of a complete antenna system tested with only 9" RG-58 cable so that the influence of the cable loss is negligible.

For lowest loss and flat response inside the usage band, the condition should be satisfied that $k*Q_L=1$, where k is the coupling coefficient and $Q_L$ is the loaded Q of the resonant system. For PCN and the proposed U.S. broadband PCS, $Q_L$ is selected to equal 9 in order to ensure the needed bandwidth. k may be adjusted by tuning the "Anchor" elements. $Q_O$ should be high to minimize loss since the $Q_O/Q_L$ ratio decides the overall coupling loss.

In order to minimize the losses contributed by the feed lines, the PC board (70, 80) material should be carefully selected. Rogers Corp.'s RO4003™ low cost microwave substrate is used in the preferred embodiment. G-10(FR-4) board and/or stamped metal elements can be used for further cost reduction. In this case, the substrate (printed circuit board or plastic) should be partially routed out to reduce dielectric loss since the E field is concentrated at the ring aperture.

Having described and illustrated the principles of my invention with reference to a preferred embodiment, it should be apparent that the invention can be modified in arrangement and detail without departing from such principles. Accordingly, I claim as my invention all such modifications as may come within the scope and spirit of the following claims, and equivalents thereto.

I claim:

1. In a mobile antenna assembly adapted for on-glass mounting, the assembly including a whip antenna, an outside coupling component, and an inside coupling component, the whip antenna being coupled to the outside coupling component, the outside coupling component being adapted for mounting adjacent an outer surface of said glass, the inside coupling component being adapted for mounting adjacent an inner surface of said glass opposite said outside coupling component, an improvement wherein the outside and inside coupling components cooperate to form an annular ring aperture coupler to thereby effect electromagnetic coupling through said glass.

2. The antenna system of claim 1 which further comprises a coaxial cable connected to said inside coupling component and extending to a radio transceiver.

3. The antenna system of claim 1 in which the whip antenna comprises a collinear array having lower and upper sections, the lower section having a length of approximately ½ wavelength, the upper section having a length between ½ and ⅝ wavelength.

4. The mobile antenna assembly of claim 1 in which the inside coupling component includes a conductive region having a first portion, said first portion having a non-arcuate edge contour.

5. The mobile antenna assembly of claim 1 in which the outside coupling component includes a conductive region having a second portion, said second portion having a non-arcuate edge contour.

6. The mobile antenna assembly of claim 5 in which the whip antenna is connected to said second portion.

7. An antenna system employing annular slot aperture coupling, including:

a substrate having first and second sides, the first side including first and second conductive regions, the second region being centrally disposed within the first region, said regions thereby defining an annular gap therebetween, the second side including third and fourth conductive regions, the third region being connected to the first region, the fourth region including a main arm extending away from the third region, the fourth region further including at least two side members extending from said main arm, symmetrically disposed thereabout.

8. The antenna system of claim 7 in which the fourth region includes a first pair of side members extending outwardly from said main arm and curving away from the third region, and a second pair of side members extending outwardly from said main arm and curving towards said third region, said first pair of side members being disposed between said third region and said second pair of side members.

9. The antenna system of claim 7 in which said first and third regions are connected by a plurality of plated vias extending through said substrate.

10. A window-mounted mobile antenna assembly according to claim 7 which further includes a second substrate having conductive regions formed thereon, said substrates being positioned on opposing sides of said window, thereby forming an inside substrate and an outside substrate, and a whip antenna connected to a conductive region on the outside substrate.

11. The window-mounted mobile antenna of claim 10 in which the whip antenna comprises a collinear array having lower and upper sections, the lower section having a length of approximately ½ wavelength, the upper section having a length between ½ and ⅝ wavelength.

12. The antenna assembly of claim 10 which further includes a coaxial cable connected to a conductive region on the inside substrate.

13. An antenna assembly employing annular slot aperture coupling, including:

a first substrate having first and second sides, the first side including first and second conductive regions, the second region being centrally disposed within the first region, said regions thereby defining a substantially annular gap therebetween, the second region including a stub extending towards the first region across the annular gap, said stub having notches devoid of conductive material adjacent sides thereof so the stub extends from a central region of the second region rather than from the periphery thereof; and a radiating element connected through said second side of the substrate to the stub on the first side of the substrate.

14. The antenna assembly of claim 10 further comprising a whip antenna and a second substrate, the whip antenna comprising said radiating element, the first substrate being disposed adjacent an outer surface of a vehicle window, the second substrate being disposed adjacent an inner surface of the vehicle window, wherein a window-mounted mobile antenna assembly is provided.

15. The antenna assembly of claim 14 in which the whip antenna comprises a collinear array having lower and upper sections, the lower section having a length of approximately ½ wavelength, the upper section having a length between ½ and ⅝ wavelength.

16. In an on-glass mobile antenna including a whip, an outer member, and an inner member, the whip being mounted to the outer member, and outer and inner members being positioned on opposing sides of a vehicle glass, the inner and outer members including first and second patterned circuit boards which, alone, effect through glass coupling and antenna matching without any lumped circuit component, an improvement wherein a first of the circuit boards includes, on a first side thereof, first and second conductive regions defining an annular gap therebetween.

17. The mobile antenna of claim 16 in which the whip antenna comprises a collinear array having lower and upper sections, the lower section having a length of approximately ½ wavelength, the upper section having a length between ½ and ⅝ wavelength.

18. The mobile antenna of claim 16 in which the first circuit board includes, on the first side thereof, a conductive region having a non-arcuate edge contour.

19. The mobile antenna of claim 13 in which the second circuit board includes a conductive region having a non-arcuate edge contour.

20. The mobile antenna of claim 19 in which the whip is connected to said region of the second circuit board having the non-arcuate edge contour.

21. A mobile antenna assembly employing a through-glass annular ring coupler, said coupler having components adapted to mount on inner and outer surfaces of a vehicle window, the assembly comprising:

an antenna;

a feedline having shield and center conductors;

an inner circuit board and an outer circuit board for mounting adjacent said inner and outer surfaces of the vehicle window, respectively, each of said circuit boards having a glass side for positioning nearest the vehicle glass, and a non-glass side opposite said glass side;

peripheral and central regions of the glass side of the inner circuit board including conductive foil and defining a generally annular-shaped non-conducting band therebetween;

the non-glass side of the inner circuit board having a first conductive region along one side thereof, said first conductive region being connected to the shield conductor of the feedline;

the non-glass side of the inner circuit board having a second conductive region extending generally perpendicularly away from the first conductive region, said second conductive region being connected to the center conductor of the feedline;

the glass side of the outer circuit board including a first region of conductive foil therearound and including a second region of conductive foil centrally located therein, said first and second regions being insulated from each other, the second region of conductive foil being connected to the antenna at a point along an axis of symmetry of said region.

22. The system of claim 21 in which the non-glass side of the outer circuit board has no conductive foil thereon.

23. The system of claim 21 in which the second region of conductive foil on the glass side of the outer circuit board has first and second ends, the antenna being connected to said foil at the first end, the second end having an arcuate edge.

24. The system of claim 21 in which the foil on the glass side of the inner circuit board includes at least one axis of symmetry.

25. The system of claim 21 in which the second conductive region on the non-glass side of the inner circuit board has an axis of symmetry.

26. In a glass-mounted vehicle antenna system including a whip antenna and a through-glass coupler, the coupler including an inner circuit board disposed on an inner side of said glass and an outer circuit board disposed on an outer side of said glass, each of said circuit boards having a glass-facing side and a non-glass-facing side, the whip antenna being coupled to a conductive material on the outer circuit board, an improvement wherein peripheral and central regions of the glass-facing side of the inner circuit board include conductive foil and define a generally annular-shaped non-conducting band therebetween, and the whip antenna is connected directly to said conductive material on the outer circuit board.

27. The antenna system of claim 26 in which the glass-facing side of the outer circuit board includes a first region of conductive foil therearound and includes a second region of conductive foil centrally located therein, said first and second regions being insulated from each other, the second region of conductive foil being connected to the antenna at a point along an axis of symmetry of said second region.

28. The antenna system of claim 26 in which the foil on the glass-facing side of the inner circuit board includes at least one axis of symmetry.

29. The antenna system of claim 26 in which the second conductive region on the non-glass-facing side of the inner circuit board has an axis of symmetry.

30. The antenna system of claim 26 in which the non-glass-facing side of the outer circuit board has no conductive foil thereon.

31. In a glass-mounted vehicle antenna system including a whip antenna and a through-glass coupler, the coupler including an inner circuit board disposed on an inner side of said glass and an outer circuit board disposed on an outer side of said glass, each of said circuit boards having a glass-facing side and a non-glass-facing side, the whip antenna being coupled to a conductive material on the outer circuit board, an improvement wherein:

peripheral and central regions of the glass-facing side of the inner circuit board include conductive foil and define a generally annular-shaped non-conducting band therebetween; and a conductive region on at least one of said circuit boards defines a region having a non-arcuate edge.

32. The antenna system of claim 31 in which a conductive region on the inner circuit board defines the non-arcuate edge.

33. The antenna system of claim 31 in which a conductive region on the outer circuit board defines the non-arcuate edge.

34. The antenna system of claim 33 in which the whip antenna is connected to said conductive region on the outer circuit board defining the non-arcuate edge.

* * * * *

UNITED STATES PATENT AND TRADEMARK OFFICE
CERTIFICATE OF CORRECTION

PATENT NO. : 5,898,408

DATED : April 27, 1999

INVENTOR(S) : Xin Du

It is certified that error appears in the above-identified patent and that said Letters Patent is hereby corrected as shown below:

Column 1, line 28, "PCNIPCS" should be - -PCN/PCS- -

Column 3, line 35, "$M = EX\hat{n}$" should be- -$\vec{M} = \vec{E}X\hat{n}$- -

Column 5, line 8, "width A 5/8" should be - -width. A 5/8- -

Column 8, line 64, "claim 10 further" should be - -claim 13 further- -

Column 9, line 27, "claim 13 in" should be - -claim 16 in- -

Signed and Sealed this

Thirtieth Day of November, 1999

*Attest:*

*Attesting Officer*

Q. TODD DICKINSON

*Acting Commissioner of Patents and Trademarks*